US007198328B2

(12) United States Patent
Costaglia

(10) Patent No.: US 7,198,328 B2
(45) Date of Patent: Apr. 3, 2007

(54) LOCKING DEVICE FOR AN OFFICE CHAIR STRUCTURE WITH AN ARTICULATION PERMITTING THE MOVEMENT OF THE SEAT AND THE SEAT BACK AND RELATED STRUCTURES OF THE CHAIR

(75) Inventor: Massimo Costaglia, Galliera Veneta (IT)

(73) Assignee: Metalseat Srl, Galliera Veneta (IT)

( * ) Notice: Subject to any disclaimer, the term of this patent is extended or adjusted under 35 U.S.C. 154(b) by 0 days.

(21) Appl. No.: 10/742,040

(22) Filed: Dec. 19, 2003

(65) Prior Publication Data

US 2004/0130197 A1 Jul. 8, 2004

(30) Foreign Application Priority Data

Dec. 31, 2002 (IT) ..... TV2002A0161

(51) Int. Cl.
*A47C 1/24* (2006.01)

(52) U.S. Cl. ..... 297/301.4; 297/301.5; 297/303.1; 297/303.4; 297/362.12; 297/363

(58) Field of Classification Search ..... 297/354.1, 297/361.1, 301.5, 301.6, 300.5, 300.6, 301.4, 297/300.1, 303.1, 303.4, 302.4, 301.7, 302.7, 297/362.12, 363, 302.1, 302.5, 302.6
See application file for complete search history.

(56) References Cited

U.S. PATENT DOCUMENTS 553,042 A * 1/1896 Ritter ..... 297/344.18
712,495 A * 11/1902 Chichester ..... 297/301.4
3,434,756 A * 3/1969 Walkinshaw ..... 297/301.4
4,408,800 A * 10/1983 Knapp ..... 297/301.2
4,565,404 A * 1/1986 Rauschenberger ..... 297/19
4,986,601 A 1/1991 Inoue
5,511,852 A * 4/1996 Kusiak et al. ..... 297/301.4
6,019,429 A 2/2000 Tedesco
6,033,020 A * 3/2000 Ito ..... 297/302.4
6,149,236 A * 11/2000 Brauning ..... 297/301.2
6,588,843 B1 * 7/2003 Ebenstein ..... 297/300.1
6,712,428 B2 * 3/2004 Moreschi ..... 297/303.4
6,758,523 B2 * 7/2004 VanDeRiet et al. ..... 297/300.5
6,761,408 B2 * 7/2004 Lim et al. ..... 297/362.12

* cited by examiner

*Primary Examiner*—Peter M. Cuomo
*Assistant Examiner*—Sarah B. McPartlin
(74) *Attorney, Agent, or Firm*—Egbert Law Offices

(57) ABSTRACT

A locking device in an office chair structure of the type with articulation permitting the movement of the adjustable seat and seat back, with a mobile base from which a column rises, which is adjustable in height, and which supports a seat plane and a hinged seat back. The structure of the office chair includes a seat, attached at the front to the corresponding front side of a central support body secured to the top of the adjustable column along the vertical axis;

a central support body, which, at the back, keeps in place the lower ends of the two support uprights of the armrests and a seat back connected to the seat, swinging and linked, near to the back part, to the central support body by means of a compression spring;

Coaxially to the compression spring, there is a rod, one side of which is integral with the back rest, while the other side is axially mobile with respect to a static connecting body linked to the central support body of the chair.

3 Claims, 4 Drawing Sheets

LOCKING DEVICE FOR AN OFFICE CHAIR STRUCTURE WITH AN ARTICULATION PERMITTING THE MOVEMENT OF THE SEAT AND THE SEAT BACK AND RELATED STRUCTURES OF THE CHAIR

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The subject of the present invention is a locking device for an office chair structure with an articulation permitting the movement of the seat and the seat back.

The proposal finds a particular, but not exclusive, application in the sector of quality chairs for office furnishings.

BACKGROUND OF THE INVENTION

In office chairs, to enable a more comfortable seating position than chairs of the static type, they incorporate, in addition to a device for adjusting the height, the use of a device for the controlled swinging of the seat back or the seat plane and the seat back, generally located in the part immediately beneath the seat plane and integral to it. Each device is primarily activated via a protruding lever that can easily be gripped and therefore rotated in one direction or another, until the internal mechanism releases the articulation.

In short, it is therefore possible to maintain that the following are known:

1. Chairs in which the seat and seat back are designed with separate body shells, which are connected in such a way that an inclination of the seat back corresponds to a parallel downward movement of the seat plane;
2. Chairs in which only the seat back is freely swinging;
3. Chairs in which the raising of the seat plane corresponds to the inclination of the seat back;
4. Chairs in which both the seat and the seat back are individually adjustable;
5. Finally, seats in which both the seat plane and the seat back, which are interconnected, perform a synchronized inclination movement.

Prior Art

By way of an example, a first dynamic device for chairs is described in FR2075176 (Suspa), involving a base equipped with a number of support arms, from which an upright rises, composed of a gas cylinder. The end of said gas cylinder, from which the activation button of the piston protrudes, is inserted inside a hole in the shape of a truncated cone, extracted monolithically from the containing box structure of the device.

U.S. Pat. No. 4,986,601 (Inoue) mentions a swinging mechanism to support a seat and the seat back of a chair, consisting of a central column that extends from the base of the chair, a first support clamp connected to the central column by means of a pedestal, a second support clamp connected to the chair and hinged to the first support clamp by means of a shaft, a third support clamp connected to the rear support and hinged by means of a shaft to the second support clamp, and a shaft that hinges the first support clamp to the third support clamp. U.S. Pat. No. 4,986,601 (Inoue) also provides for a gas piston with a valve that can be actuated by a rod in the central column to selectively adjust the height of the column. Finally, U.S. Pat. No. 4,986,601 (Inoue) also provides for spring mechanisms to exert an opposing force on the second support clamp, positioned between the first and second clamps.

DE0198056 (Neumuller) is of interest. This is a swinging mechanism to support the seat plane and seat back of a chair, consisting of a central column that extends from the base of the chair, a first support clamp connected to the central column, a second support clamp connected to the seat plane and pivoted to the first clamp by a first pivot, a third support clamp connected to the seat back and hinged to the second support clamp by a second pivot, in addition to a mechanism that pivots the first support clamp to the third support clamp. Finally, DE0198056 (Neumuller) provides for spring mechanisms positioned between the first and second support clamps, to exert an opposing force to the movement of the second clamp.

Prior Art Concerning the Subject of the Invention

EP0329455 (Aero) proposes a device to adjust the inclination and lock the back of a chair. In more detailed terms, this is a push-button device positioned along the external side and at the end of one of the two arms of an aircraft seat. Said button controls the running of a cable arranged coaxially to a sheath, integrated into the arm and extending along the same towards the back until it reaches the termination underneath the seat plane, where an actuator device is positioned. Said actuator device is composed of a cylinder which, on one side, provides the activation button stimulated by means of a set of levers, from the small cable connected to the button and, from the other side, activates, via the shaft, a movement arm controlled by the seat back.

Finally, U.S. Pat. No. 6,019,429 (Global) proposes a control device for a chair for office use. In this specific case, it is a question of at least one control button integrated into the arm of a chair, and more specifically located directly underneath the support plane afforded by the same arm, along the side and appearing towards the inside of the seat. In this hypothesis, the button is inserted coaxially to a support, consisting of a cylindrical guide body that can be implemented in the structure of the arm. Even more specifically, said support provides for the protrusion, on one side, of the button, which remains external with respect to the arm, and on the other side (internally to the arm), by means of a fork arrangement, locks, with the lower part of the same, the end of the sheath, from which the respective control cable emerges. The end of said control cable is implemented next to one end of an overhanging lever with an "L" arrangement. This lever is in turn pivoted, at the side, to the upper part of the fork, a little above the lower one. It usually consists of a pre-tensioned cable, which, by means of the lever, ensures that the button always protrudes towards the outside, enabling the user to activate the adjustment device by means of exerting a light pressure on the same, in such a way as to cause the swinging of the lever in an upward direction, which therefore subsequently pulls the control cable. To permit the activation of the cylinder, which in this case always controls the single function of locking/releasing the back, the other end of the flexible cable also uses a lever, which is pivoted, with a spring-back mechanism, at the side of the activation button located next to said movement cylinder of the back. In this way, with the button in the depressed position, the lever pivoted to the movement cylinder is brought considerably closer to the base that holds the end of the sheath, with the result that, by means of a denticle, the latter exerts a force on the activation button, thus controlling the exit of the shaft.

Disadvantages

In short, it is possible to maintain that the proposals referred to, U.S. Pat. No. 4,986,601 (Inoue) or even DE0198056 (Neumuller), on the other hand, solutions that are conceptually very similar in the effect of the interaction of the three clamps, require locking/release mechanisms which are rather complex, involving a large number of components. Even if one ignores this last aspect, which it can easily be imagined involves objective difficulties and warehouse management costs, the complex interaction between the components sometimes does not permit them to function optimally. That is to say that conditions can arise in which the mechanism, having been brought into the locking state, is engaged only along a small part of its length, with the consequence that an accidental release is always possible. In addition, this can be operated only by means of a lever positioned underneath the seat plane, which is particularly inconvenient for the user.

As regards the proposal U.S. Pat. No. 6,019,429 (Global) and EP0329455 (Aero), it is a matter of devices that operate only with the possibility of adjusting the seat back. In addition, to be activated in the release state, they require the user to maintain a certain pressure on the activation button, a condition which may involve a precarious balance for the user. Furthermore, it may occur that the user, when not supported by the back, suffers the effect of the sudden and violent return of the seat back to a forward position, which is a particularly annoying condition that gives rise to feelings of insecurity in the mind of the user, and a lack of confidence in the product.

BRIEF SUMMARY OF THE INVENTION

This and other purposes are fulfilled by the present innovation, according to the characteristics of which in the annexed claims, it solves the problems indicated above by means of a locking device in an office chair structure of the type with articulation permitting the movement of the adjustable seat and seat back, with a mobile base from which a column rises, which is adjustable in height, and which supports a seat plane and a hinged seat back, whereby the structure of the office chair consists of:

- the seat, attached at the front to the corresponding front side of a central support body secured to the top of the adjustable column along the vertical axis;
- the central support body, which, at the back, keeps in place the lower ends of the two support uprights of the armrests, equipped with a device for adjusting the height of the chair and a device for locking/releasing the swinging of the seat back and seat, said uprights being further hinged in an intermediate position along the sides of the seat;
- the seat back connected to the seat, swinging and linked, near to the back part, to the central support body by means of a compression spring;

in which, coaxially to the compression spring, there is a rod, one side of which is integral with the back rest, while the other side is axially mobile with respect to a static connecting body linked to the central support body of the chair, said static body being equipped with a mobile control pin perpendicular to said rod to intercept the corresponding adjustment holes situated along the same.

Purposes

In this way, by means of the notable creative contribution, the effect of which constitutes an immediate technological advance, certain objectives are achieved, all substantially geared to permitting the use of a more functional seat in comparison to the pre-existing solutions.

A first purpose consists of eliminating the inconvenience of the non-return effect of the seat back, thus avoiding possible violent and undesirable returns of the seat back.

A second purpose is that of permitting an automatic search function for the locking position.

A third purpose is that of providing a particularly efficient and functional locking/release device that is compatible with remote control devices that use flexible cables.

A fourth purpose consists of the provision of a light-weight and small-size mechanisms that requires a reduced number of components, low maintenance, and easy assembly at competitive times and costs.

In conclusion, a chair structure can be realized that is equipped with a good technological content and integrates as many functions as possible.

This and other advantages will be discussed in the following detailed description of at least one preferential solution for the implementation with the aid of the annexed schematic diagrams, the specifics of the execution of which are not intended to be restrictive, but only exemplary.

BRIEF DESCRIPTION OF THE SEVERAL VIEWS OF THE DRAWINGS

Finally.

DETAILED DESCRIPTION OF THE INVENTION

Figure 1:
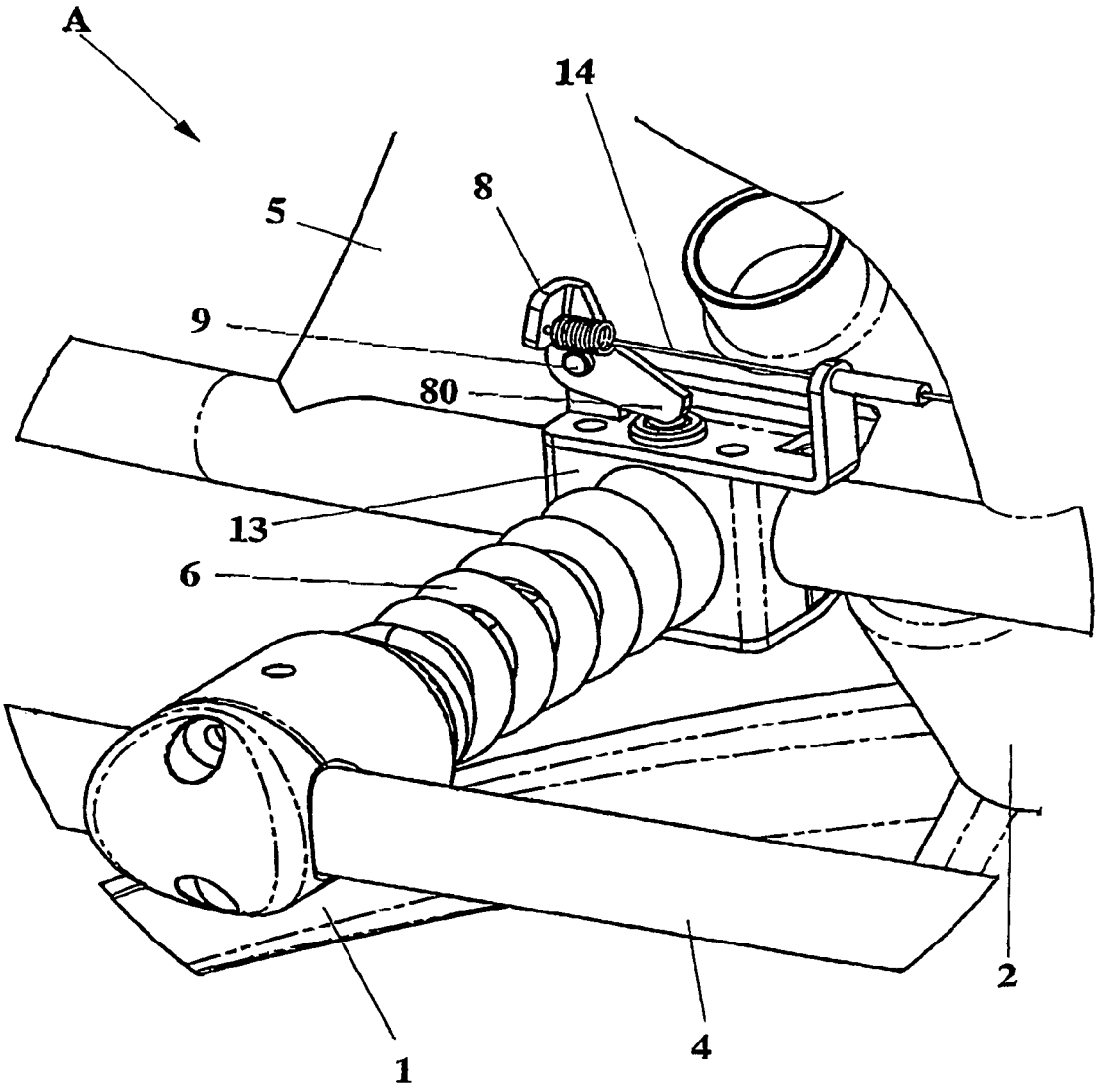
FIG. 1 is a perspective view of the rear part of the chair structure, which involves an intermediate cushioned means of attachment which links the support of the seat back and the seat plane to the central support body of the chair, in which the locking/release device is represented in the locking state of the swinging of the chair.
Figure 2:
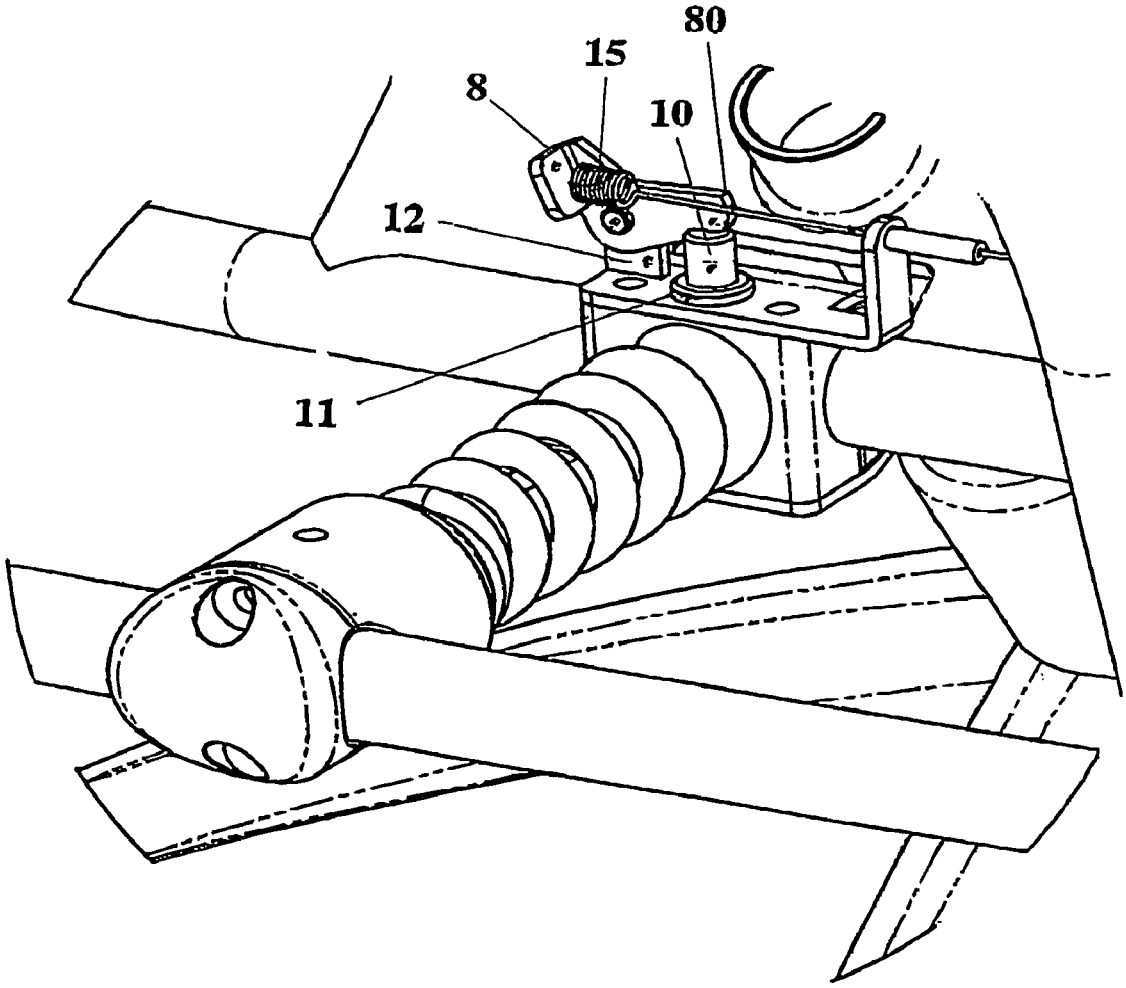
FIG. 2 is another perspective view of the rear part of the chair structure in FIG. 1, in which the locking/release device is represented in the release state of the swinging of the chair.
Figure 3:
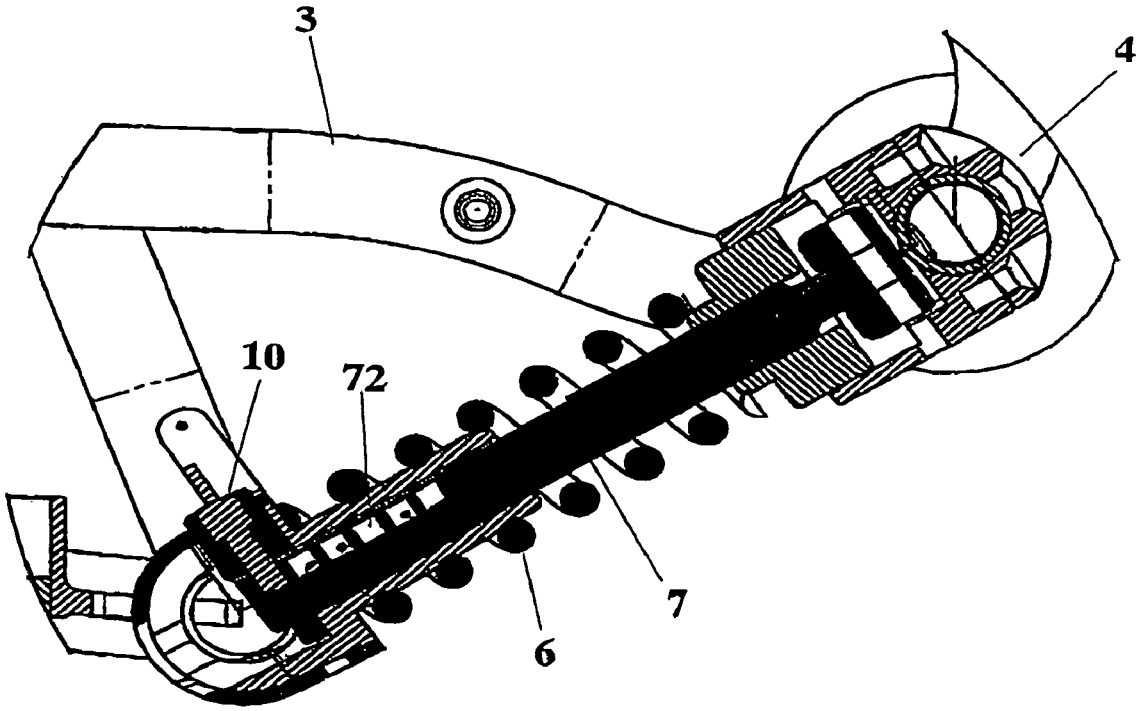
FIG. 3 is a lateral section view of the locking/release device, represented in the locking state of the swinging of the chair.
Figure 4:
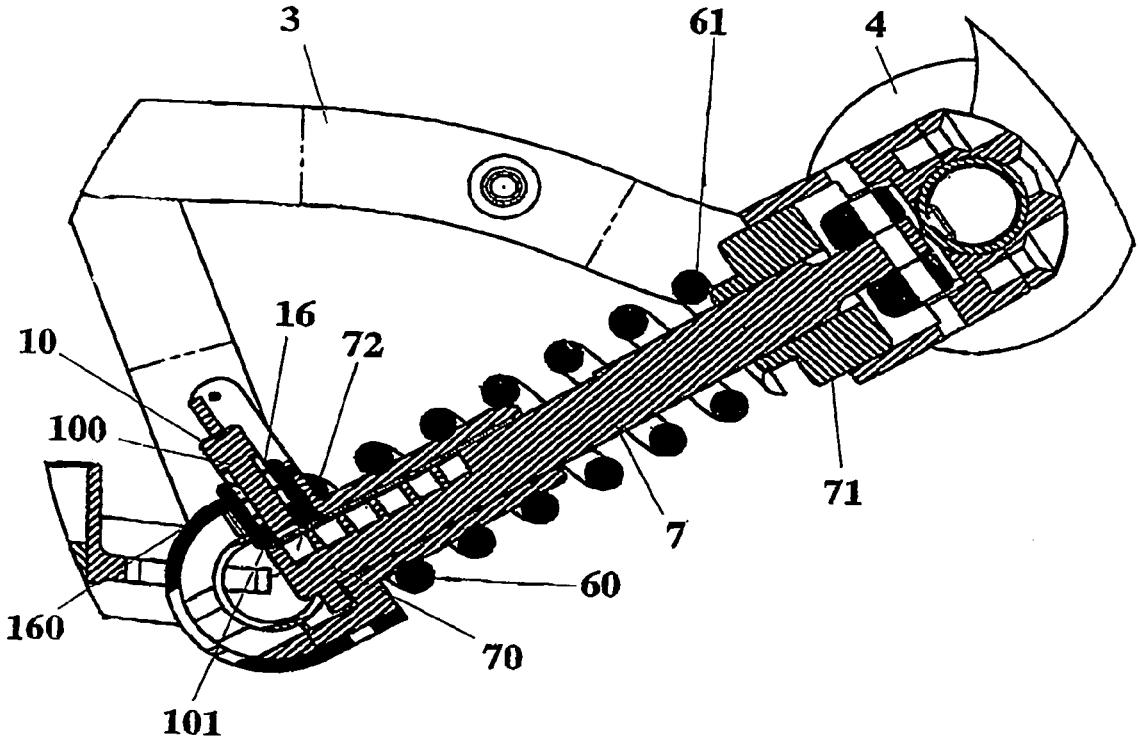
FIG. 4 is a lateral section view of the locking/release device, represented in the release state of the swinging of the chair.

Taking the figures as a reference, it is observed that the structure of an office chair A is of the type composed of a base 1 which, by means of a column 2 connected to a central support body 5, supports a seat plane 3 and a seat back 4 above.

Said central support body 5 involves, along the rear part, preferably in the middle position, the use of one end 60, 70 of the two ends of an adjustable assembly composed of a helical compression spring 6 and the relative coaxial rod 7 used for alignment and guidance. The opposite ends 61, 71 of the assembly 6, 7 are, on the other hand, linked to the lower end of the seat back 4 and, in more detail, in a middle position with respect to a tubular transverse connecting element.

In even more detail, by means of an adjustment action performed by means of a mechanism located near to the lower end of the seat back 4, the rod 7 may move forwards or backwards, thus increasing or reducing the inclination of the seat back 4 and the seat 3. The locking device in question is composed of a trigger lever 8 pivoted to a pin 9 that engages in a support 10. The trigger lever 8 is capable of rotating around the pin 9, with the front part 80 which is in contact with the head of the pin 10, which is inserted in a bushed bearing 111 integral with the support 12 on the static body 13 used for the ends 60, 70 of the assembly of the helical compression spring 6 and the related coaxial rod 7. The rotation of the trigger lever 8, by the effect of the action exert by the flexible cable 14 on it, determines the transfer movement of the pin 10 along the relative axis, perpendicularly with respect to the end 70 of the rod 7. The pin 10 is implemented with a shoulder 100 so as to have two diameters, and therefore the lower part of the pin 101 with the smaller diameter is capable of being inserted in the series of holes 72 present on one side and aligned along the end 70 of the rod 7. The forward motion of the rod 7 determines possible alignment positions between the lower pin 101 and the series of holes 72 provided along the end 70 of the rod 7.

a) Locking Phase.

According to a possible system of activation of the seat or the mechanism, in this case by means of at least one button that activates the cable 14, we determine the rotation of the trigger lever 8 around its own pin 9 wit the consequent movement of the pin 10. The function of the spring 15 is to permit a continuous pushing action of the trigger lever 8 on the pin 10, even in the presence of the state of non-alignment between said pin 10 and one of the holes 72. Since the traction system of the cable 14 in this case is bistable, we have the situation whereby, once the lever or button has been activated by the user, the cable 14 remains in the traction position. If the pin 10 is in a state of alignment with one of the holes 72, the insertion occurs. Conversely, if alignment is not attained, then the spring 15 lengthens, maintaining a force on the trigger lever 8 and the pin 10. As soon as the user moves the seat back 4 of the chair and determines the movement of the rod 7, a state of alignment occurs and therefore the pin 10 is inserted. In this case, this behavior of the system is defined as automatic finding of the locking position.

b) Release Phase.

When the release device is activated by the user, the release of the cable 14 occurs, which therefore no longer transmits the traction force to the spring 15 and the trigger lever 8. The return of the pin 10 into the release position is guaranteed at this point by the spring 16 which exerts a force on the housing 160 of the same pin 10, inside the static body 13. Said housing 160 possesses a hole with a diameter greater than the hole in the lower part, which constitutes an extension of the lower housing that guides the part of the pin 101 having a smaller diameter. If the user converts the locking device in the release position but not support on the seat back 4 of the chair, the "non-return" effect of the seat back 4 occurs, determined by the thrust of the spring 6. More precisely, it occurs that, once the thrust action on the pin 10 of the trigger lever 8 is eliminated (consequent upon the action of releasing all of the other components upstream), then the spring 6 exerts a notable thrust that involves a cutting pressure between the pin 10 and the respective hole 72. However, as this is not the thrust of the trigger lever 8, the pin 10 therefore remains permanently in its own hole 72. Only when the user pushes on the seat back of the chair does the resetting of the abovementioned cutting pressure occur, and consequently the withdrawal of the pin 10 by the effect of the action of the return spring 16. Such a function is defined as "antishock".

I claim:

1. An apparatus for an office chair comprising:

a seat back;

a base;

a column extending upwardly from said base;

a central support body with a seat plane thereon, said seat back being hingedly connected to said central support body, said central support body positioned adjacent a top of said column opposite said base;

a compression spring positioned between a lower side of said seat back and said central support body;

a rod having one end affixed to said lower side of said seat back, said rod extending coaxially with said compression spring, said rod having an opposite end cooperative with said central support body;

a static connecting body linked to said central support body, said opposite end selectively axially mobile through said static connecting body, said rod having a plurality of aligned holes arranged longitudinally adjacent said opposite end of said rod, said static connecting body having a control pin resiliently mounted thereon, said control pin extending into said static connecting body so as to selectively engage one of said plurality of aligned holes so as to fix an angular position of said seat back with respect to said central support body, said control pin being a generally cylindrical member having a top end extending outwardly of said static connecting body and an opposite end engageable with said one of said plurality of aligned holes; and a lever pivotally connected to said static connecting body, said lever having a side in contact with a head at said top end of said control pin, said control pin slidably extending through a bushed bearing, said bushed bearing affixed to said static connecting body, said compression spring having an end affixed to said static connecting body, said static connecting body slidably receiving said opposite end of said rod, said control pin extending perpendicular to the longitudinal axis of said rod, said control pin having a first diameter and a second diameter with a shoulder defined therebetween, said second diameter being smaller than said first diameter, said second diameter being receivable within one of said plurality of holes, said static connecting body having a guideway formed therein, said guideway extending perpendicular to said rod, said static connecting body having a spring in said guideway so as to resiliently urge said control pin outwardly away from said rod.

2. The apparatus of claim 1, said lever being resiliently connected to a flexible cable extending therefrom.

3. The apparatus of claim 2, said flexible cable having a spring positioned therealong.

* * * * *